US011478943B2

(12) United States Patent
Fuerst et al.

(10) Patent No.: US 11,478,943 B2
(45) Date of Patent: Oct. 25, 2022

(54) HAIR REMOVAL DEVICE

(71) Applicant: Braun GmbH, Kronberg (DE)

(72) Inventors: Stefan Fuerst, Kronberg (DE); Reinhold Eichhorn, Idstein (DE); Martin Fuellgrabe, Bad Camberg (DE); Thomas Verstege, Frankfurt am Main (DE); Renata Burghardt, Kronberg (DE)

(73) Assignee: Braun GMBH, Kronberg (DE)

( * ) Notice: Subject to any disclaimer, the term of this patent is extended or adjusted under 35 U.S.C. 154(b) by 56 days.

(21) Appl. No.: 16/364,768

(22) Filed: Mar. 26, 2019

(65) Prior Publication Data

US 2019/0299433 A1 Oct. 3, 2019

(30) Foreign Application Priority Data

Mar. 27, 2018 (EP) ..... 18164333

(51) Int. Cl.
*B26B 19/04* (2006.01)
*B26B 19/38* (2006.01)
*B26B 19/10* (2006.01)

(52) U.S. Cl.
CPC ..... *B26B 19/048* (2013.01); *B26B 19/046* (2013.01); *B26B 19/10* (2013.01); *B26B 19/3853* (2013.01)

(58) Field of Classification Search
CPC ..... B26B 19/04; B26B 19/046; B26B 19/048; B26B 19/063; B26B 19/10; B26B 19/105; B26B 19/12; B26B 19/14; B26B 19/145; B26B 19/146; B26B 19/20; B26B 19/205;
(Continued)

(56) References Cited

U.S. PATENT DOCUMENTS 2,526,153 A * 10/1950 Page ..... B26B 19/26 30/43.91
2,574,317 A * 11/1951 Berg ..... B26B 19/042 30/34.1

(Continued)

FOREIGN PATENT DOCUMENTS

CN 1017911805 8/2010
CN 109789587 5/2019

(Continued)

OTHER PUBLICATIONS

Yamauchi, Yasuaki; Notice of Reasons for Refusal dated May 18, 2020; Japanese Patent Application No. 2019-044484; Japanese Patent Office.

(Continued)

*Primary Examiner* — Ghassem Alie
*Assistant Examiner* — Samuel A Davies
(74) *Attorney, Agent, or Firm* — Kevin C. Johnson; Gerd Zetterer

(57) ABSTRACT

A hair removal device, in particular an electric shaver, comprising a working head attached to a handle for moving the working head along a skin surface, said working head including at least a pair of short hair cutters and at least one trimmer neighboring at least one of said short hair cutters, wherein said short hair cutters and said trimmer are movable relative to said handle under a skin contact pressure.

19 Claims, 5 Drawing Sheets

(58) Field of Classification Search
CPC . B26B 19/26; B26B 19/3853; B26B 19/3866; B26B 19/265
See application file for complete search history.

(56) References Cited

U.S. PATENT DOCUMENTS 5,189,792 A * 3/1993 Otsuka ..... B26B 19/046 30/41.6
5,367,771 A * 11/1994 Mukai ..... B26B 19/046 30/43.91
5,398,412 A * 3/1995 Tanahashi ..... B26B 19/10 30/43.9
5,490,328 A 2/1996 Ueda et al.
5,653,026 A * 8/1997 Tezuka ..... B26B 19/046 30/43.9
5,704,126 A * 1/1998 Franke ..... B26B 19/046 30/34.1
5,745,995 A 5/1998 Yamashita et al.
5,946,806 A * 9/1999 Watanabe ..... B26B 19/288 30/43.92
6,317,982 B1 11/2001 Andrew
7,137,205 B2 * 11/2006 Royle ..... B26B 21/225 30/527
7,841,090 B2 * 11/2010 Eichhorn ..... B26B 19/048 30/43.92
2001/0039734 A1 * 11/2001 Kadijk ..... B26B 19/384 30/43.6
2005/0016002 A1 1/2005 Fukutani et al.
2005/0229400 A1 * 10/2005 Yamaguchi ..... B26B 19/048 30/43.92
2007/0022607 A1 * 2/2007 Takeuchi ..... B26B 19/38 30/43.92
2008/0134515 A1 * 6/2008 Sato ..... B26B 19/10 30/43.91
2011/0308088 A1 * 12/2011 Brada ..... B26B 19/143 30/43.6
2012/0055025 A1 * 3/2012 Pohl ..... B26B 19/10 30/34.1
2012/0151774 A1 * 6/2012 Shimizu ..... B26B 19/10 30/43.92
2016/0031100 A1 * 2/2016 Provolo ..... B26B 19/386 30/41.6
2016/0257008 A1 * 9/2016 Sato ..... B26B 19/046
2018/0085934 A1 3/2018 Erndt et al.

FOREIGN PATENT DOCUMENTS

CN 110303528 A 10/2019
DE 4418644 A1 12/1994
EP 2404716 1/2012
EP 2404716 B1 9/2012
EP 3546146 A1 10/2019
EP 3300863 B1 6/2020
JP H06233873 A 8/1994
JP H6335572 A 12/1994
JP 2001129272 A 5/2001
JP 2005040358 A 2/2005
JP 2009528863 A 8/2009
JP 2009540975 A 11/2009
JP 5009940 B2 8/2012
JP 2019171034 A 10/2019

OTHER PUBLICATIONS

Rattenberger, B.; Article 94(3) EPC dated Jul. 15, 2020; European Patent Application No. 18164333.9; European Patent Office.
European search report dated Oct. 12, 2018.

* cited by examiner

HAIR REMOVAL DEVICE

FIELD OF THE INVENTION

The present invention relates to a hair removal device, in particular an electric shaver, comprising a working head attached to a handle for moving the working head along a skin surface, said working head including at least a two short hair cutters and at least one trimmer neighboring at least one of said short hair cutters, wherein said short hair cutters and said trimmer are movable relative to said handle under a skin contact pressure.

BACKGROUND OF THE INVENTION

Hair removal devices such as an electric shaver, epilators, or beard trimmers usually include different types of cutting and trimming devices so as to allow for removing long hairs as well as medium hairs and short hairs and stubbles, as commonly found in men's beards and women's legs. Short hair cutters may include a movable cutting blade or undercutter which cooperates with a thin, flexible mesh screen or apertured or perforated foil, wherein such mesh screen or foil may have a rounded, elongated contour and the undercutter may reciprocate under such elongated, rounded contour of the mesh screen along a longitudinal axis thereof. Other types of short hair cutters use rotatory cutter elements which may be driven in an oscillating or a continuous manner and may cooperate with disc-shaped mesh screens covering said rotatory cutter elements. By means of slidingly guiding the mesh screen or perforated foil over the skin surface to be shaved, the individual hair shafts enter the holes formed in the screen or foil and are cut by the movement of the cutting blades.

Although such short hair cutters have proven to be extremely effective, they have difficulties in cutting longer hair fibers typically encountered on necks and women's legs, or generally skin surfaces unshaved for a couple of days. Such medium or longer hair fibers tend to bend or curl what prevents the terminating end of the hair from entering the mesh screen what results in these longer hair fibers remaining uncut.

For such medium and/or longer hair fibers, separate hair trimmers are provided at the working head, wherein such trimmers may be positioned adjacent to one of the short hair cutters. For example, such trimmers may form an elongated block extending along one of the elongated, rounded mesh screens or perforated foils of the short cutters, wherein it is known to have such trimmers in a retracted, non-operative position below the skin contact surface of the short cutters so the trimmer does not contact the skin surface when the short cutters slide along the skin surface. On the other hand, it is known to slide the trimmer into an active position in which the trimmer projects above the skin contact surface of the short cutter. Such trimmers may include a cutter bar with a pair of sickle finger bars reciprocating relative to each other, but may also include a foil or cover plate having comparatively larger apertures under which an undercutter with cutting blades may reciprocate or continuously rotate to cut hairs entering the apertures.

It is also known to have such trimmers in a position substantially aligned with and/or substantially on the same height as the skin contact surface of the short hair cutters so as to effect short hair cutting as well as long hair cutting at the same time.

For example, document U.S. Pat. No. 6,317,982 B1 discloses an electric shaver with a shaver head including a pair of short cutters and a pair of trimmers with the short cutters being positioned next to each other in the center of the shaver head and the trimmers being positioned at an outer side of the short hair cutters, wherein the trimmers may be moved relative to the short hair cutters into three positions in which the trimmers are retracted below the top surface of the mesh screen of the short hair cutters or substantially aligned with the upper top surface of the short cutters or extended and raised above said top surface of the short cutters.

Furthermore, document US 2005/0016002 A1 discloses an electric shaver having a shaver head with a pair of short hair cutters arranged in a center portion of the shaver head between a pair of long hair trimmers. The shaver head includes a pair of outer cutter frames each of which accommodates a short hair cutter and a long hair trimmer, wherein each of said outer cutter frames is movable relative to the handle and independently of each other. More particularly, each of said outer cutter frames may float relative to the handle and may swing relative to the handle about an axis substantially perpendicular to the longitudinal axis of the short hair cutter block and the long hair trimmer block and also perpendicular to the longitudinal axis of the handle so—in other words—a left end of the elongated trimmer and elongated short hair cutter may rotate into a further projecting position whereas the opposite left end of said short hair cutters and trimmers may rotate into a less projecting position and vice versa. Due to such swingable configuration of the outer cutter frames and the cutters and trimmers accommodated therein, a better adaption to the skin contour is promised when the handle is guided in an orientation not perpendicular to the skin surface.

However, despite such movability of the short hair cutters and trimmers, problems may arise when skin portions are shaved which are not flat, but significantly convex or concave or uneven in multiple directions. In particular, when the working head includes a plurality of short hair cutters and a plurality of trimmers which should be active at the same time, the shaver head does not only have a significant width transverse to the sliding direction (along which the working head slides along the skin surface), but also has a significant extension perpendicular to said width and substantially parallel to the sliding direction so it might be that only one or none of the short hair cutters contacts the skin due to the trimmers contacting a heightened portion of the skin contour or only one or none of the trimmers may contact the skin due to the short hair cutters contacting an elevated skin contour portion.

SUMMARY OF THE INVENTION

It is an objective underlying the present invention to provide for an improved hair removal device avoiding at least one of the disadvantages of the prior art and/or further developing the existing solutions. A more particular objective underlying the invention is to provide for an improved working head structure of such hair removal device with improved coexistence of short hair cutters and trimmers with less interference of skin contact of each of said short hair cutters and trimmers. Another objective underlying the present invention is to allow for further improved self-adaption of the short hair cutters and trimmers to complex skin contours, in particular to allow for better adjustment of the short hair cutters and trimmers to convex and concave skin contours.

To achieve at least one of the aforementioned objectives, the hair removal device has an improved working head structure allowing for pivoting movements of the at least one trimmer relative to at least one of the multiple short hair cutters about a pivot axis extending substantially parallel to a plane separating the trimmer from the neighboring short hair cutter and substantially parallel to a plane perpendicular to the longitudinal axis of the handle. Due to such pivoting movement of the trimmer relative to at least one of the short hair cutters, both the short hair cutter and the trimmer may contact the skin surface in a substantially perpendicular orientation when the working head slides across a concave contour and/or a convex contour.

More particularly, there may be a at least one trimmer or a pair of trimmers and at least two short hair cutters mounted on a pair of support frames pivotably supported relative to each other about a common or a pair of separate pivot axes each parallel to the aforementioned first and second planes between a first pivot position in which said at least one trimmer or a pair of trimmers and said at least two short hair cutters together define a concave skin contact contour, and a second pivot position in which said at least one trimmer or a pair of trimmers and at least two short hair cutters together define a convex skin contact contour. Said skin contact contour is in fact defined by the top surfaces of the short hair cutters and trimmers facing away from the handle and/or forming the upper top surface of the hair removal device when considering the handle in an upright position, wherein such skin contact surface of the working head is not necessarily—and is usually not—a smooth, flat surface due to the curved surfaces of the mesh screen of the short hair cutters and the gaps between the separate cutters and trimmers, but nevertheless the surfaces of the short hair cutters and trimmers together define a sort of enveloping surface which may become concave as well as convex, and may become a flat plane in an intermediate configuration between convex and concave, due to the pivoting support of the pair of frames accommodating the trimmers and short hair cutters.

Due to such pivotable arrangement the trimmers and short hair cutters, a very flat, compact structure of the working head can be combined with an improved self-adaption of the working head to varying skin contours. More particularly, an orientation of the trimmers and short hair cutters substantially perpendicular to the skin surface can be achieved to allow hairs to enter the apertures of the cutter foils even when moving the working head over uneven skin contours, wherein on the other hand at least one of the short hair cutters and/or at least one of the trimmers contacts the skin with higher contact pressure whereas another at least one of the short hair cutters and/or trimmers is pressed against the skin with less pressure due to differing leverage arms from the pivot axis, thus achieving high pressure and low pressure cutting at the same time.

These and other advantages become more apparent from the following description giving reference to the drawings and possible examples.

DETAILED DESCRIPTION OF THE INVENTION

Figure 1:
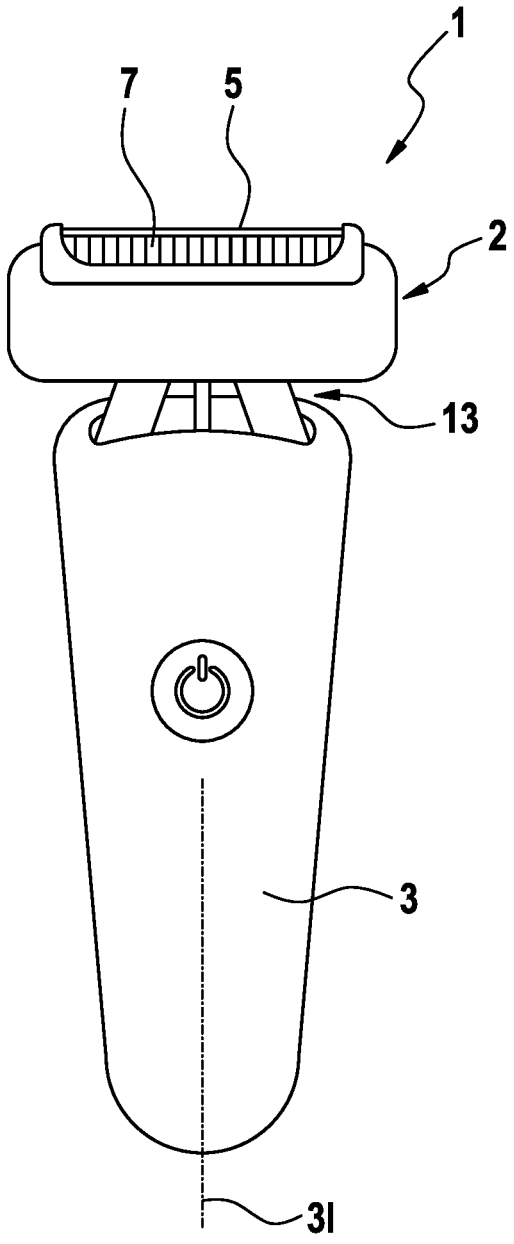
FIG. 1 is a front view of a hair removal device in terms of an electric shaver comprising a handle and a working head attached thereto, said working head including a pair of trimmers in addition to short hair cutters.

To achieve a very flat, compact working head combined with an improved self-adaption of the working head to varying skin contours, the hair removal device has an improved working head structure allowing for pivoting movements of the at least one trimmer relative to at least one of the multiple short hair cutters about a pivot axis extending substantially parallel to a first plane separating the trimmer from the neighboring short hair cutter and substantially parallel to a second plane perpendicular to the longitudinal axis of the handle. Due to such pivoting movement of the trimmer relative to at least one of the short hair cutters, both the short hair cutter and the trimmer may contact the skin surface in a substantially perpendicular orientation when the working head slides across a concave contour and/or a convex contour.

More particularly, there may be at least one trimmer or a pair of trimmers ("pair of trimmers" also includes in the following the alternative of at least one trimmer not limited to an adjacent/pairwise arrangement of one or more trimmers) and a pair of short hair cutters ("pair of short hair cutters" means in the following at least two short hair cutters independent of its arrangement relative to each other) mounted on a pair of support frames pivotably supported relative to each other about a common or a pair of separate pivot axes each parallel to the aforementioned first and second planes between a first pivot position in which said pair of trimmers and said pair of short hair cutters together define a concave skin contact contour, and a second pivot position in which said pair of trimmers and pair of short hair cutters together define a convex skin contact contour. Said skin contact contour is in fact defined by the top surfaces of the short hair cutters and trimmers facing away from the handle and/or forming the upper top surface of the hair removal device when considering the handle in an upright position, wherein such skin contact surface of the working head is not necessarily—and is usually not—a smooth, flat surface due to the curved surfaces of the mesh screen of the short hair cutters and the gaps between the separate cutters and trimmers, but nevertheless the surfaces of the short hair cutters and trimmers together define a sort of enveloping surface which may become concave as well as convex, and may become a flat plane in an intermediate configuration between convex and concave, due to the pivoting support of the pair of frames accommodating the trimmers and short hair cutters.

The aforementioned pair of support frames may be pivotably supported about a common pivot axis or, in the alternative, about a pair of separate pivot axes wherein such separate pivot axes may be arranged parallel to each other. In both cases, the common pivot axis or the pair of separate pivot axes may extend parallel to the aforementioned first and second planes in a center portion of the working head and/or between the pairs of short hair cutters and trimmers. More particularly, the common pivot axis and/or the separate pivot axes may extend in a center portion of the working head on opposite sides of which are arranged two cutter and/or trimmer elements each. In other words, on one side of the common pivot axis or separate pivot axes there may be arranged a pair of short hair cutters or one short hair cutter and one trimmer, whereas on the other side of the pivot axis/axes there may be arranged a pair of trimmers or one trimmer and one short hair cutter. Such centered arrangement of the pivot axis of the support frame provides for a balanced, substantially symmetrical arrangement of the working head and its short hair cutters and trimmers in terms of "two-and-two" on both sides of the pivot axis, thereby achieving a smooth self-adaption to various skin contours irrespective of the stroke direction in which the working head is guided over the skin contour. One or both of the pair of support frames may have a longitudinal length parallel to the common pivot axis or, in the alternative, to the pair of separate pivot axes, and extending along at least a substantial portion of a longitudinal length of at least one trimmer.

The short hair cutters and trimmers may be grouped in different ways and/or arranged in different positions relative to each other. According to an aspect, it is advantageous to have a short hair cutter positioned at an outside of the working head and another short hair cutter positioned at an inner side of the working head, and on the other hand to have a trimmer positioned on an opposite outside of the working head and another trimmer positioned at an inner side of the working head. Such grouping of the short hair cutters and trimmers may lead to an order "short hair cutter—trimmer—short hair cutter—trimmer" when going along the working head in a direction perpendicular to the pivot axis.

Due to such asymmetric arrangement of the cutter and trimmer elements, it is possible to have the outer short hair cutter remove hairs from corner portions or edges such as the upper lip portion below the nose, whereas on the other hand the trimmer on the opposite outer side may be used to trim edge contours of hair fields such as a beard's edge. At the same time, the trimmer at the inner side of the working head helps the short hair cutters when there are longer hairs or special hairs such as curled hairs, whereas the short hair cutter at the inner side close to the pivot axis allows for a relatively high contact pressure and thus, deeply cutting of remaining stubbles.

According to another advantageous arrangement, one of the short hair cutters and/or one of the trimmers is configured to contact the skin with higher contact pressure whereas another one of the short hair cutters and/or trimmers is configured to contact the skin with less pressure due to differing biasing and/or differing leverage arms from the pivot axis, thus achieving high pressure and low pressure cutting at the same time.

Another advantageous arrangement may have the short hair cutters and trimmers in an order short hair cutter—short hair cutter—trimmer—trimmer. In such arrangement, there is also a short hair cutter at an outer side of the working head and a trimmer at an opposite outer side of the working head so short hair cutting below the nose may be achieved as well as trimming of hair fields' edges as described before. Having the short hair cutters accommodated on the same pivot frame and the trimmers accommodated on the other pivot frame allows for use of different working head sides and/or different stroke directions for different hair removal purposes. Stroke direction means the direction of the movement of the working head along the skin as guided by the handle, as usually users guide the shaver with reciprocating "strokes" along the skin. More particularly, using the trimmer side of the working head, i.e. the side where the two trimmers are arranged, as a front side so that first the trimmers glide along the skin with the short hair cutters on the other side of the working head following the trimmers, may achieve removal of longer and/or curved hairs before the remaining stubbles are removed by the short hair cutters. On the other hand, when the short hair cutter side is used as the front side of a stroke, the pair of short hair cutters arranged on said side achieves a particularly thorough removal of stubbles which are cut twice, i.e. by said pair of short hair cutters sliding over a skin portion one behind the other.

Another advantageous arrangement of the short hair cutters and trimmers may include a pair of trimmers positioned on opposite outer sides of the working head with a pair of short hair cutters arranged therebetween so that an order "trimmer—short hair cutter—short hair cutter—trimmer" may be given. With such symmetrical arrangement of the trimmers and short hair cutters, longer or curled hairs are safely cut before the short hair cutters reach the respective skin portion, irrespective of the direction of the stroke with which the working head is guided along the skin. At the same time, due to the arrangement of the short hair cutters at the inner side of the working head close to the pivot axis, a relatively high pressure between the short hair cutters and the skin is achieved so short stubbles may be deeply removed.

According to an aspect, the aforementioned pivot frame supporting the trimmers and short hair cutters may be biased towards the aforementioned first pivot position in which the trimmers and short hair cutters together define a concave skin contact contour of the working head so the support frames may pivot against the biasing force and/or biasing torque into the aforementioned second pivot position defining a convex skin contact contour or an intermediate position defining a flat configuration, when the working head is pressed against the skin surface. Such biasing force and/or torque may be provided by a spring device urging the support frames to pivot about the aforementioned common pivot axis or separate pivot axes into said first pivot position. Basically, the biasing device may urge the pivot frames away from the handle.

Such biasing device may act directly upon the support frames so a skin contact pressure urging one of the support frames to pivot is directly transferred onto the other support frame. In other words, the biasing device may provide for biasing the support frames relative to each other only.

In the alternative or in addition, however, the biasing device also may provide for biasing forces acting between at least one of the support frames and the handle and/or a working head base structure so that the biasing force and/or biasing torque does not only control pivoting of the support frames relative to each other, but also controls pivoting of the support frames relative to the handle and/or relative to the base structure of the working head.

The first biasing element of the support frames relative to each other can be stiffer than the second biasing element of the at least one support frame relative to the handle/work head base structure.

In addition to the pivotable arrangement of the support frames, the short hair cutters and/or the trimmers may be movably supported relative to the support frames. In particular, at least one of the short hair cutters and/or at least one of the trimmers may move in a "floating" manner relative to the support frame on which it is mounted. Such floating allows for diving of the respective trimmer element and/or short cutter element under skin contact pressure relative to the support frame in a direction substantially perpendicular to the top surface of the short hair cutter and/or top surface of the trimmer which top surface contacts the skin surface, and/or along a substantially circular path. In other words, such floating or diving allows for movements of the trimmer and/or short hair cutter in a direction substantially perpendicular to the skin contact contour of the working head and/or along a substantially circular or/and curved path. Said direction substantially perpendicular to the skin contour of the working head is considered as such a direction also if it includes a curved path as long as the main movement direction component is still substantially perpendicular to the skin contact contour of the working head According to an aspect, the trimmer and/or short hair cutter which is supported movably in said manner so as to allow for diving and/or floating, may be biased into a projecting position, i.e. towards the skin surface, e.g. by means of a biasing spring device so a respective trimmer element or short hair cutter element may dive into a more retracted position under the skin contact pressure.

Such additional movability of the trimmer and/or short hair cutter relative to the support frames allows for a further improved, more sophisticated self-adaption of the working head to the skin contour.

These and other features become more apparent from the examples shown in the drawings. As can be seen from FIG. 1, the hair removal device may be configured as an electric shaver 1 comprising a shaver housing forming a handle 3, wherein in the interior of the handle 3 a drive unit including an electric motor and an electronic control unit may be accommodated. Such handle 3 may have an elongated, substantially bone-shaped configuration extending along a longitudinal axis 31.

At one end of said handle 3, a working head 2 may be mounted to said handle 3, wherein the working head 2 may be movably supported at said handle 3. For example, the support structure 13 supporting the working head 2 at the handle 3 may allow for one-axial or multi-axial pivot and/or swiveling movements of the entire working head 2 relative to the handle 3.

In addition to such basic movability, the working head 2 may allow for a sort of internal movements. More particularly, the working head 2 includes a pair of short hair cutters 4 and 5 and a pair of trimmers 6 and 7 which are supported movably relative to a working head base structure 14 which may be supported by the aforementioned support structure 13 onto the handle 3.

More particularly, the working head 2 may include a pair of support frames 11 and 12 which may be pivotably supported at said base structure 14 about a pivot axis 8 or a pair of separate pivot axes 8*a*/8*b* to allow for pivoting movements of the support frames 11 and 12 relative to the base structure 14.

Said pivot axis 8 may extend parallel to a first plane 9 separating one of the trimmers 6, 7 from one of the short hair cutters 4 and 5 and parallel to a second plane 10 extending substantially perpendicular to the aforementioned longitudinal axis 31 of handle 3.

Figure 2:
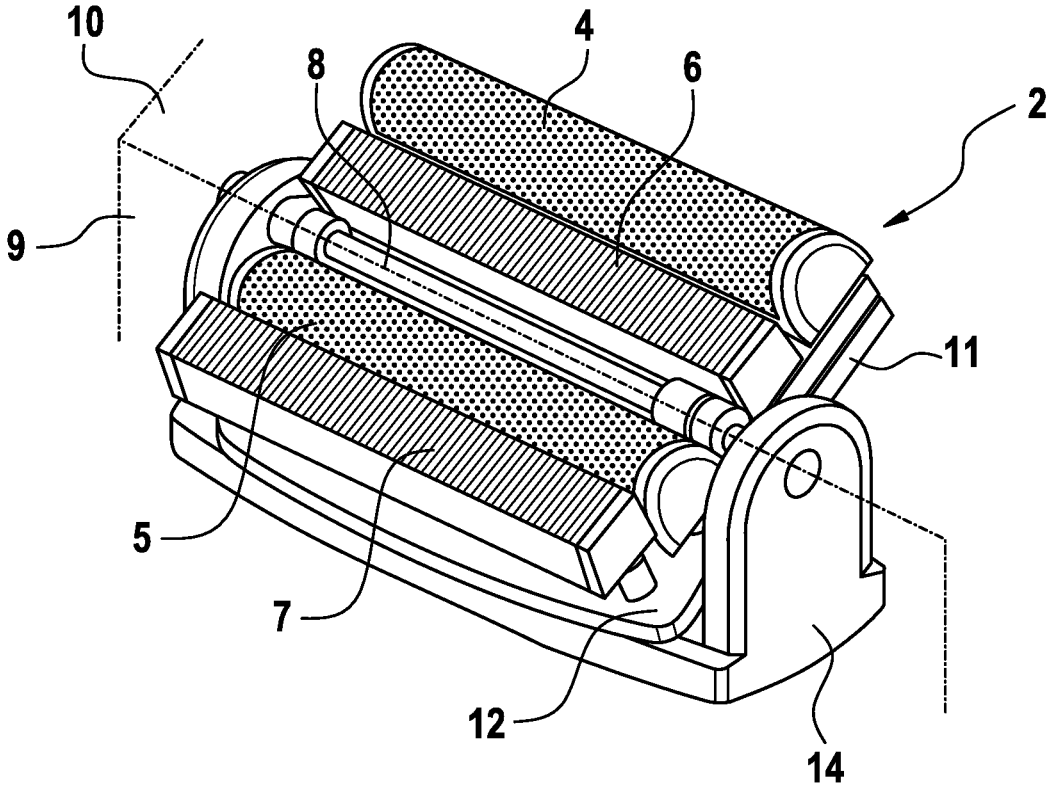
FIG. 2 is a perspective view of the working head of the hair removal device of FIG. 1, showing the arrangement of two trimmers and two short hair cutters on a pair of pivotably supported frames.

As can be seen from FIG. 2, the aforementioned short hair cutters 4 and 5 and the aforementioned trimmers 6 and 7 may have an elongated, substantially block-like shape and/or an elongated, substantially rectangular shape, wherein the short hair cutters 4 and 5 may include a flexible mesh screen with a curved surface under which an undercutter and/or cutter blade block may reciprocate. On the other hand, the trimmers 6 and 7 may include a pair of sickle finger bars reciprocating relative to each other and/or an apertured foil with relatively large apertures under which an undercutter with cutting blades may reciprocate.

Due to the aforementioned elongated shape of the short hair cutters and trimmers the skin contact surface of the working head 2 formed by the top surfaces of the aforementioned short hair cutters 4 and 5 and trimmers 6 and 7 may have a strip-like configuration and as a whole, may have a rectangular configuration when viewed from the top.

Figure 3:
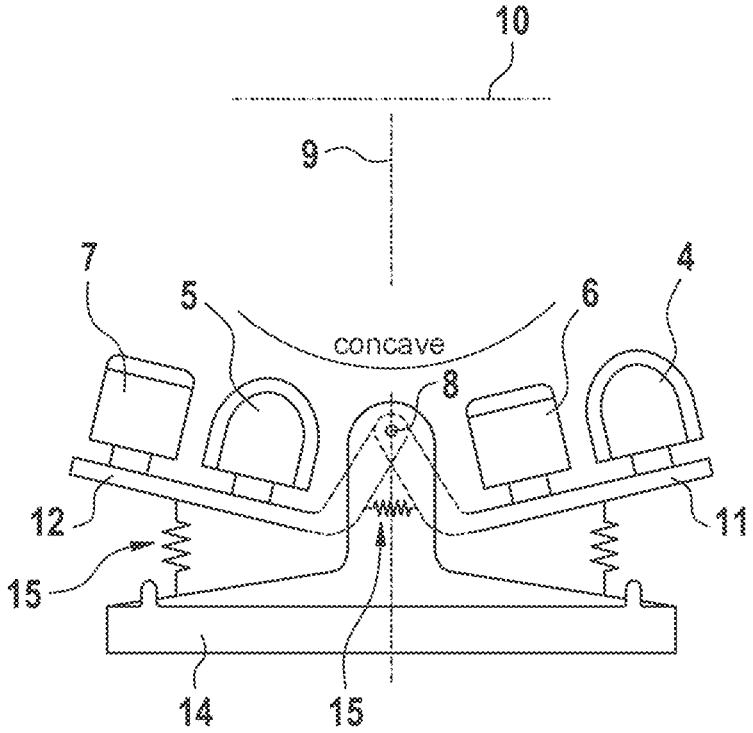
FIG. 3 is a side view in the direction of the pivoting axis of the support frames showing the short hair cutters and trimmers in a first pivot position defining a concave skin contact contour.
Figure 4:
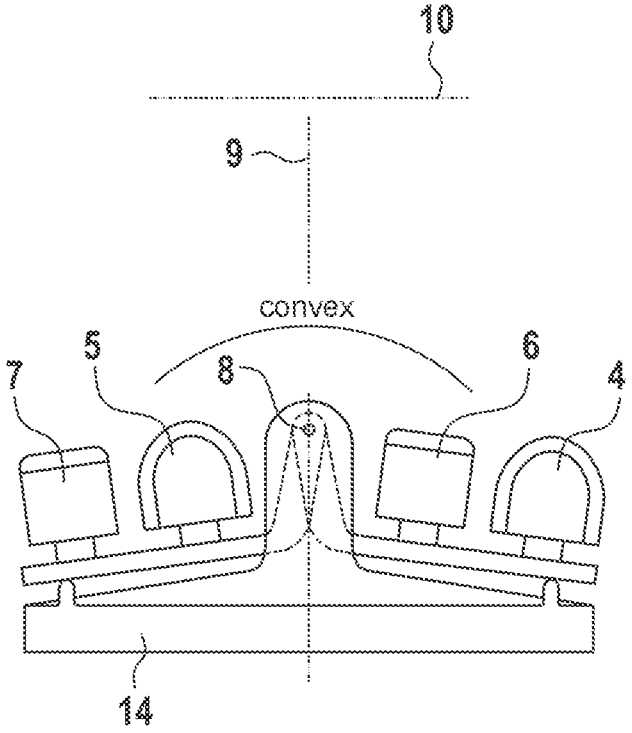
FIG. 4 is a side view of the working head of FIGS. 2 and 3 similar to FIG. 3, but showing the short hair cutters and trimmers in a second pivot position defining a convex skin contact contour.
Figure 5:
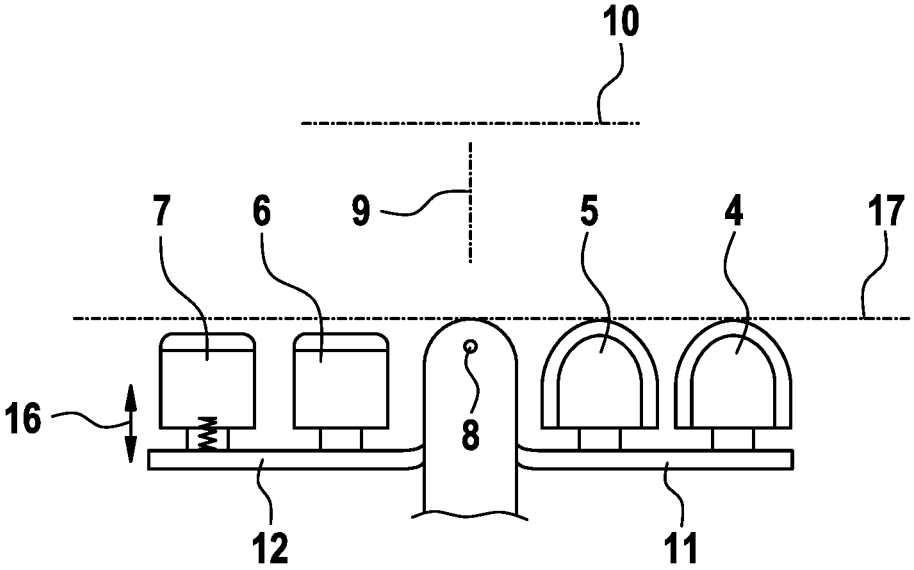
FIG. 5 is a side view of a working head basically similar to FIGS. 2 to 4, wherein the arrangement of the short hair cutters and trimmers is different, wherein both trimmers are accommodated on the same support frame and the two short hair cutters are arranged on the other support frame, wherein an intermediate position is shown in which the trimmers and short hair cutters define a substantially flat skin contact contour.
Figure 6:
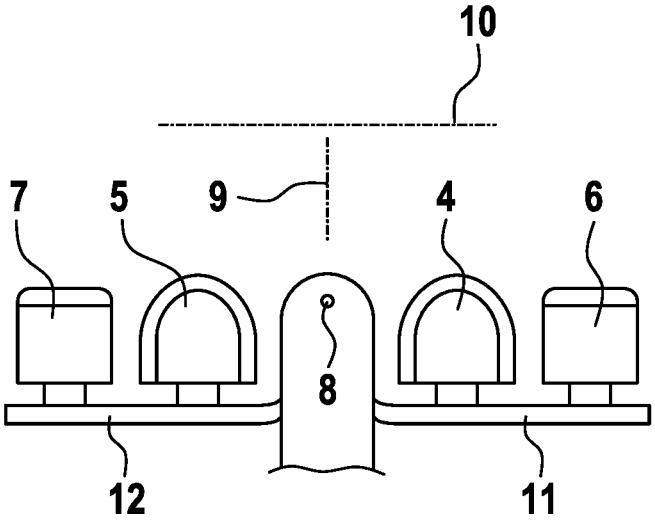
FIG. 6 is a side view of a working head similar to FIGS. 2 to 5, wherein—in contrast to FIGS. 3 to 5—the pair of short hair cutters are positioned at an inner side of the working head close to the pivot axis and between the pair of trimmers arranged at an outside of the working head.
Figure 7:
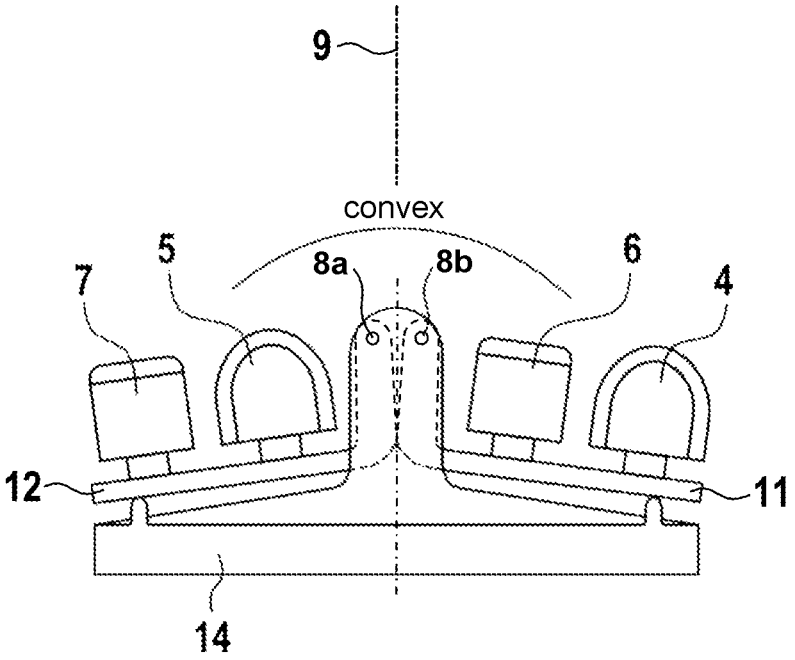
FIG. 7 is a side view of the working head of FIGS. 2 and 3 similar to FIG. 4, but showing a pair of separate pivot axes.

As can be seen from FIGS. 3, 4, and 7, the aforementioned pivot axis 8 or pair of separate pivot axes 8*a*/8*b* of the support frames 11 and 12 may be arranged at a height very close to the top surface of the trimmers 6 and 7 and short hair cutters 4 and 5, at least when the support frames 11 and 12 are in an intermediate pivot position in which the trimmers 6 and 7 and short hair cutters 4 and 5 together define a substantially flat plane, cf. FIG. 5 and FIG. 6.

In said intermediate pivot position, the support frames 11 and 12 also may extend substantially in a common plane what is, however, not necessary.

As can be seen from FIGS. 3 and 4, the support frames 11 and 12 may pivot relative to each other so that the skin contact surface of the working head 2 as defined by the top surfaces of the trimmers 6 and 7 and short hair cutters 4 and 5 may be changed from a substantially concave shape to a substantially convex shape (with a flat configuration in an intermediate position therebetween).

More particularly, when considering the intermediate position of FIGS. 5 and 6, each of the support frames 11 and 12 may pivot about an angle of at least +/−5° or +/−7° or +/−10° or +/−20° or +/−30° and more. For example, when each support frame 11 and 12 may pivot about an angle of +/−20°, said pairs of support frames 11 and 12 may pivot relative to each other over an angular range of about 80°.

When considering two enveloping planes one of which touching the top surfaces of the cutter and/or trimmer elements on one support frame and the other touching the top surfaces of the trimmer and/or short hair cutter elements on the other support frame, such enveloping planes may define an angle of about 140° to 170° in the first pivot position defining the concave skin contact contour and, on the other hand, an angle of about 190° to 200° in the second pivot position defining the convex skin contact contour, cf. FIGS. 3 and 4.

As can be seen from FIG. 3, a biasing device 15 may be provided for biasing the support frames 11 and 12 towards the concave configuration, wherein such biasing device 15 may include a spring device pivoting the support frames 11 and 12 about pivot axis 8 relative to each other only and/or a spring device urging the support frames 11 and 12 away from the base structure 14 of working head 2 and thus away from the handle 3.

As can be seen from FIG. 5, at least one of the trimmers 6 and 7 and/or the short hair cutters 4 and 5 may be movably supported onto said support frames 11 and 12 so as to allow for a diving movement 16 of the respective trimmer 6 or 7 and/or the respective short hair cutter 4 and 5 relative to the support frame 11 and 12. Such diving movement 16 may be oriented in a direction substantially perpendicular to the skin contact contour of the working head 2, and/or on a circular path.

As can be seen from FIGS. 2 to 4, the trimmers 6 and 7 and short hair cutters 4 and 5 may be arranged in an asymmetric manner and/or in an order "short hair cutter—trimmer—short hair cutter—trimmer". More particularly, a short hair cutter 4 may be arranged at an outer side of the working head 2 and a trimmer 7 may be positioned at an opposite outer side of the working head 2, wherein such outer side means the working head portion further away from the center and/or forming a periphery or periphery portion.

Furthermore, another short hair cutter 5 may be positioned at an inner side and also another trimmer 6 may be positioned at an inner side of the working head 2.

In the alternative, as shown by FIG. 5, both short hair cutters 4 and 5 may be positioned at one side of the working head 2 and/or mounted to the same support frame 11, whereas on the other hand both trimmers 6 and 7 may be positioned at the opposite side of the working head 2 and/or mounted to the other support frame 12. In such configuration, the order "short hair cutter—short hair cutter—trimmer—trimmer" is achieved.

Furthermore, as shown by FIG. 6, the trimmers 6 and 7 may be arranged at opposite outer sides of the working head 2 with the two short hair cutters 4 and 5 positioned therebetween in a middle or center portion of the working head 2.

Any of the above embodiments may include a working head with one, two, three or four long hair trimmers and/or one or two or three or four short hair cutters wherein at least one of such hair cutting unit may be replaced by another functional element (e.g. comb) or one or more functional non hair cutting unit(s) (e.g. a comb, a guard or slim benefit bar, which benefit bar may provide skin or hair benefit by treating or applying something onto same) may be provided in addition next to at least one of the hair cutting units or between two hair cutting units. The hair cutting units may include a rotary system with a circular movement direction of at least one cutting part or a linear system with a linear movement direction of at least one cutting part.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

What is claimed is:

1. A hair removal device, comprising a working head attached to a handle for moving the working head along a skin surface thereby generating a skin contact pressure, said working head including at least two short hair cutters and at least one trimmer adjacent to at least one of said at least two short hair cutters, wherein said at least one of said at least two short hair cutters has at least one cutting part with a linear movement direction, wherein at least one of said at least one trimmer is mounted on a first support frame which is pivotably supported about a first pivot axis to pivot relative to at least another one of said at least two short hair cutters under said skin contact pressure, said first support frame having a longitudinal length parallel to said first pivot axis and extending along at least a substantial portion of a longitudinal length of said at least one of said at least one trimmer, said first pivot axis extending substantially parallel to a first plane separating said at least one trimmer from said at least one and/or said at least another one of said at least two short hair cutters and substantially parallel to a second plane perpendicular to a longitudinal handle axis, further comprising a second support frame, wherein said at least one of said at least two short hair cutters is mounted on said first support frame or said second support frame, wherein said at least another one of said at least two short hair cutters is mounted on said second support frame, wherein said second support frame is pivotably supported for independent movement relative to said first support frame about said first pivot axis forming a common pivot axis.

2. The hair removal device according to claim 1, wherein said first and second support frames are pivotable between a first pivot position in which said at least one trimmer and said at least two short hair cutters together define a concave skin contact contour of the working head and a second pivot position in which said at least one trimmer and said at least two short hair cutters together define a convex skin contact contour of the working head.

3. The hair removal device according to claim 2, wherein said common pivot axis is arranged in a center portion of the working head with respect to a width of the working head in a direction (i) perpendicular to said first axis and (ii) in a plane perpendicular to said longitudinal handle axis.

4. The hair removal device according to claim 3, wherein said at least one of said at least two short hair cutters is mounted on said first support frame, and wherein at least another one of said at least one trimmer is mounted on said second support frame.

5. The hair removal device according to claim 4, wherein said at least one of said at least one trimmer is positioned at an outer side of the working head, and said at least another one of said at least one trimmer is positioned at an inner side of said working head.

6. The hair removal device according to claim 4, wherein at least two short hair cutters are positioned at an inner side of said working head between said at least two trimmers.

7. The hair removal device according to claim 2, wherein said common pivot axis is arranged at substantially the same location along said longitudinal handle axis as the skin contact contour of the working head as defined by top surfaces of said at least one trimmer and said at least two short hair cutters when considering an intermediate, flat configuration thereof.

8. The hair removal device according to claim 7, wherein said at least one trimmer includes at least two trimmers, both of which are mounted on said first support frame.

9. The hair removal device according to claim 2, wherein said first and second support frames are biased towards the aforementioned first pivot position by a biasing device to allow said first and second support frames to pivot against a biasing force, when the working head is pressed against the skin surface.

10. The hair removal device according to claim 9, wherein the biasing device includes a first biasing element for biasing said first and second support frames relative to each other only and a second biasing element for biasing at least one of said first and second support frames relative to the handle and a working head base structure to not only control pivoting of said at least one of said first and second support frames relative to each other, but also to control pivoting of said at least one of said first and second support frames relative to the handle and relative to the working head base structure, wherein said working head base structure is supported by a support structure of the handle, and wherein said first and second support frames are pivotably supported at said working head base structure.

11. The hair removal device according to claim 2, wherein said at least one of said at least two short hair cutters is movably supported relative to the support frames to allow for diving of said at least one short hair cutter under said skin contact pressure relative to the support frames in a direction substantially perpendicular to the skin contact contour of the working head.

12. The hair removal device according to claim 11, wherein said at least one short hair cutter is biased relative to said first or said second support frame into a projecting position towards the skin surface by a biasing device to allow said at least one short hair cutter to dive into a more retracted position under said skin contact pressure against a biasing force of said biasing device.

13. The hair removal device according to claim 1, wherein said at least one trimmer and said at least two short hair cutters are arranged on opposite sides of said common pivot axis.

14. The hair removal device according to claim 1, wherein one of said at least two short hair cutters is configured to contact the skin with a first contact pressure whereas another one of said at least two short hair cutters is configured to contact the skin with a second contact pressure less than the first contact pressure.

15. The hair removal device according to claim 1, wherein said linear movement direction of said at least one cutting part is parallel to said first pivot axis.

16. The hair removal device according to claim 1, wherein said first pivot axis is positioned between said at least one of said at least one trimmer and said at least one of said at least two short hair cutters.

17. The hair removal device according to claim 1, wherein said at least one of said at least two short hair cutters is mounted on the second frame so as to be adjacent to said at least one of said at least one trimmer mounted on the first support frame.

18. A hair removal device, comprising a working head attached to a handle for moving the working head along a skin surface thereby generating a skin contact pressure, said working head including at least two short hair cutters and at least one trimmer adjacent to at least one of said at least two short hair cutters, wherein said at least one of said at least two short hair cutters has at least one cutting part with a linear movement direction, wherein at least one of said at least one trimmer is mounted on a first support frame which is pivotably supported about a first pivot axis to permit a pivoting movement of said at least one of said at least one trimmer relative to at least another one of said at least two short hair cutters under said skin contact pressure, said first pivot axis extending substantially parallel to a first plane separating said at least one trimmer from said at least one and/or said at least another one of said at least two short hair cutters and substantially parallel to a second plane perpendicular to a longitudinal handle axis, further comprising a second support frame, wherein said at least one of said at least two short hair cutters is mounted on said first support frame or said second support frame, wherein said at least another one of said at least two short hair cutters is mounted on said second support frame, wherein said second support frame is pivotably supported relative to said first support frame about (i) said first pivot axis forming a common pivot axis or (ii) a second pivot axis parallel to said first and second planes wherein said first pivot axis and said second pivot axis form a pair of separate pivot axes, and wherein said first and second support frames are pivotable between a first pivot position in which said at least one trimmer and said at least two short hair cutters together define a concave skin contact contour of the working head and a second pivot position in which said at least one trimmer and said at least two short hair cutters together define a convex skin contact contour of the working head, wherein, when considering an intermediate pivoting position wherein said skin contact contour comprises a flat configuration, each of said first and second support frames is supported pivotably about an angle of at least +/−20° relative to said intermediate pivoting position.

19. A hair removal device, comprising a working head attached to a handle for moving the working head along a skin surface thereby generating a skin contact pressure, said working head including at least two short hair cutters and at least one trimmer adjacent to at least one of said at least two short hair cutters, wherein said at least one of said at least two short hair cutters has at least one cutting part with a linear movement direction, wherein at least one of said at least one trimmer is mounted on a first support frame which is pivotably supported about a first pivot axis to permit a pivoting movement of said at least one of said at least one trimmer relative to at least another one of said at least two short hair cutters under said skin contact pressure, said first pivot axis extending substantially parallel to a first plane separating said at least one trimmer from said at least another one of said at least two short hair cutters and substantially parallel to a second plane perpendicular to a longitudinal handle axis, further comprising a second support frame, wherein said at least one of said at least two short hair cutters is mounted on said first support frame, wherein said at least another one of said at least two short hair cutters is mounted on said second support frame, wherein said second support frame is pivotably supported relative to said first support frame about said first pivot axis forming a common pivot axis or (ii) a second pivot axis parallel to said first and second planes wherein said first pivot axis and said second pivot axis form a pair of separate pivot axes, and wherein said first and second support frames are pivotable between a first pivot position in which said at least one trimmer and said at least two short hair cutters together define a concave skin contact contour of the working head and a second pivot position in which said at least one trimmer and said at least two short hair cutters together define a convex skin contact contour of the working head, further comprising two planes one of which touching the top surfaces of said at least another one of said at least two short hair cutters and at least another one of said at least one trimmer mounted on said second support frame, and the other touching the top surfaces of said at least one of said at least two short hair cutters and said at least one of said at least one trimmer mounted on said first support frame, said two planes defining an angle of about 160° to about 170° in the first pivot position and an angle of about 190° to about 200° in the second pivot position.

* * * * *